US009690221B2

(12) United States Patent
Okita et al.

(10) Patent No.: US 9,690,221 B2
(45) Date of Patent: Jun. 27, 2017

(54) ELECTROSTATIC LATENT IMAGE DEVELOPING TONER

(71) Applicant: KYOCERA Document Solutions Inc., Osaka (JP)

(72) Inventors: Masaki Okita, Osaka (JP); Hiroki Uemura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/083,805

(22) Filed: Mar. 29, 2016

(65) Prior Publication Data

US 2016/0291493 A1 Oct. 6, 2016

(30) Foreign Application Priority Data

Mar. 30, 2015 (JP) ..... 2015-069450

(51) Int. Cl.
*G03G 9/08* (2006.01)
*G03G 9/087* (2006.01)

(52) U.S. Cl.
CPC ..... *G03G 9/08755* (2013.01)

(58) Field of Classification Search
CPC ..... G03G 9/08755
USPC ..... 430/109.4
See application file for complete search history.

(56) References Cited

U.S. PATENT DOCUMENTS 8,377,618 B2 2/2013 Shu et al.
2009/0075195 A1 3/2009 Shu et al.

FOREIGN PATENT DOCUMENTS

JP 2009-086642 A 4/2009

*Primary Examiner* — Mark A Chapman
(74) *Attorney, Agent, or Firm* — Studebaker & Brackett PC

(57) ABSTRACT

An electrostatic latent image developing toner includes a plurality of toner particles each containing a binder resin. The toner particles each contain as the binder resin, a crystalline polyester resin and a non-crystalline polyester resin. An FT-IR spectrum of the electrostatic latent image developing toner obtained through FT-IR analysis based on an ATR method has an absorbency peak of at least 0.0100 and no greater than 0.0250 in a wave number range of 701 $cm^{-1}$±1 $cm^{-1}$.

12 Claims, 4 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2015-69450, filed on Mar. 30, 2015. The contents of this application are incorporated herein by reference in their entirety.

BACKGROUND

The present disclosure relates to an electrostatic latent image developing toner.

An electrostatic latent image developing toner has been known that includes toner mother particles each containing a crystalline polyester resin and a non-crystalline resin.

SUMMARY

An electrostatic latent image developing toner according to the present disclosure includes a plurality of toner particles each containing a binder resin. The toner particles each contains as the binder resin, a crystalline polyester resin and a non-crystalline polyester resin. An FT-IR spectrum of the electrostatic latent image developing toner obtained through FT-IR analysis based on an ATR method has an absorbency peak of at least 0.0100 and no greater than 0.0250 in a wave number range of 701 $cm^{-1}$±1 $cm^{-1}$.

DETAILED DESCRIPTION

Figure 1:
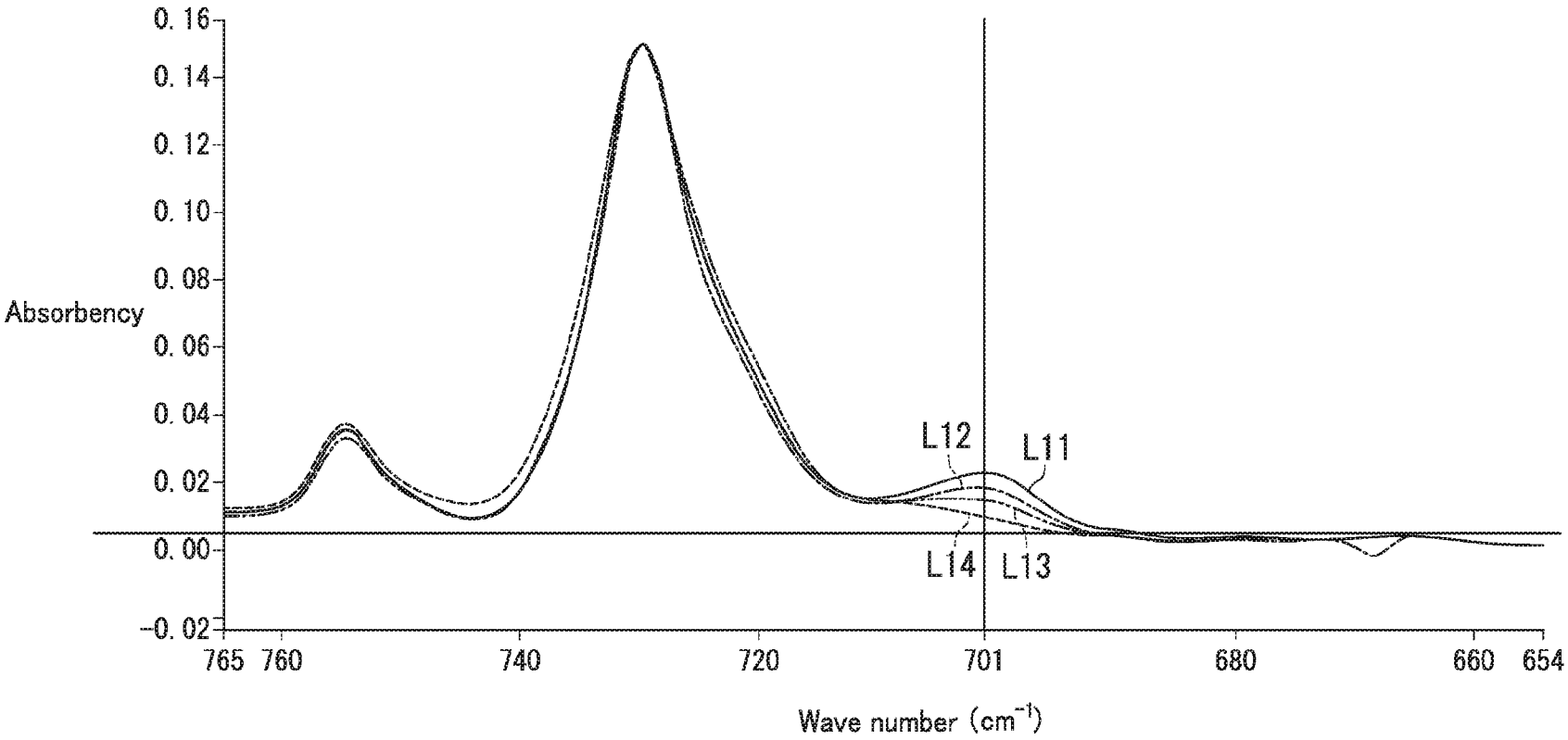
FIG. 1 is a spectral chart indicating measured FT-IR spectra of respective toners according to Examples and Comparative Examples in the present disclosure.

An embodiment of the present disclosure will be described. Note that evaluation results (values indicating shape, physical properties, or the like) for a powder (for example, toner mother particles, an external additive, or a toner) are number average values measured with respect to an appropriate number of particles of the powder unless otherwise stated.

The number average particle size of the powder is a number average value of an equivalent circular diameter of a primary particle (diameter of a circle having the same area as a projected area of a particle) measured using a microscope unless otherwise stated. A measured value of a volume median diameter ($D_{50}$) of the powder is a value measured using Coulter Counter Multisizer 3 produced by Beckman Coulter, Inc. based on Coulter principle (an electric sensing zone method) unless otherwise stated. Respective measured values of an acid value and a hydroxyl value are values measured in accordance with Japan Industrial Standard (JIS) K0070-1992 unless otherwise stated. Respective measured values of a number average molecular weight (Mn) and a mass average molecular weight (Mw) are values measured by gel permeation chromatography unless otherwise stated.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. In addition, the term "(meth)acrylonitrile" is used as a generic term for both acrylonitrile and methacrylonitrile. A subscript "n" representing a repeating unit in a chemical formula indicates the number of repetitions (the number of moles) of the repeating unit. Unless otherwise stated, n (number of repetitions) is arbitrary.

A toner according to the present embodiment can be suitably used as for example a positively chargeable toner for development of an electrostatic latent image. The toner according to the present embodiment is a powder including a plurality of toner particles (particles having respective features described later). The toner may be used as a one-component developer. Alternatively, the toner may be mixed with a carrier using a mixer (for example, ball mill) to prepare a two-component developer. In order to form a high-quality image, a ferrite carrier is preferably used as the carrier. In order to form a high-quality image durable for a long period of time, magnetic carrier particles each including a carrier core and a resin layer that cavers the carrier core are preferably used as the carrier. In a situation in which the magnetic carrier particles are produced, the carrier core may be formed by a magnetic material (for example, ferrite) or a resin in which the magnetic particles are dispersed. Alternatively, the magnetic particles may be dispersed in the resin layer covering the carrier core. In order to form a high-quality image, the amount of the toner contained in the two-component developer is preferably at least 5 parts by mass and no greater than 15 parts by mass relative to 100 parts by mass of the carrier core, and more preferably at least 8 parts by mass and no greater than 12 parts by mass. A positively chargeable toner contained in a two-component developer is positively charged by friction with a carrier.

The toner according to the present embodiment can be used in an electrophotographic apparatus (image forming apparatus) for image formation, for example. Following describes an example method by which an electrophotographic apparatus forms an image.

First of all, an electrostatic latent image is formed on a photoreceptor based on image data. Subsequently, the electrostatic latent image formed on the photoreceptor is developed using a developer containing a toner. In the developing process, a toner (toner charged by friction with a carrier or a blade) on a development sleeve (for example, a surface layer of a development roller of a developing unit) disposed in the vicinity of the photoreceptor is caused to adhere to the electrostatic latent image to form a toner image on the photoreceptor. In a subsequent transfer process, the toner image on the photoreceptor is transferred to an intermediate transfer member (for example, a transfer belt). The toner image on the intermediate transfer member is further transferred to a recording medium (for example, paper). Thereafter, the toner is fixed to the recording medium by heating the toner. Through the above, an image is formed on the recording medium. A full-color image can for example be formed by superposing toner images of four different colors: black, yellow, magenta, and cyan.

The toner according to the present embodiment includes a plurality of toner particles. The toner particles may each contain an external additive. In a configuration in which the toner particles each contain the external additive, the toner particles each include a toner mother particle and the external additive. The external additive adheres to the surfaces of the toner mother particles. The toner mother particles each contain a binder resin. The toner mother particles may each contain an internal additive (for example, any of a releasing agent, a colorant, a charge control agent, a magnetic powder) as necessary in addition to the binder resin. The external additive may be omitted in a situation in which such an external additive is not necessary. In a situation in which the external additive is omitted, the toner mother particle and the toner particle are equivalent.

The toner particles included in the toner according to the present embodiment may be either toner particles each including no shell layer (hereinafter referred to as non-capsule toner particles) or toner particles each including a shell layer (hereafter referred to as capsule toner particles). Toner mother particles of the capsule toner particles each include a core and a shell layer disposed over the surface of the core. In order to improve fixability of the toner, it is preferable that the cores of the capsule toner particles are substantially made from a thermoplastic resin. The shell layers may be substantially made from a thermosetting resin or a thermoplastic resin. Alternatively, the shell layers may contain both the thermoplastic resin and the thermosetting resin. A suitable thermoplastic resin may be selected from "preferable thermoplastic resins" listed below. Examples of thermosetting resins that can be preferably used include melamine-based resins, urea-based resins, sulfonamide-based resins, glyoxal-based resins, guanamine-based resins, aniline-based resins, polyimide resins (specific examples include maleimide polymer and bismaleimide polymer), and xylene-based resins.

The toner according to the present embodiment has the following feature (1).

(1) The toner includes a plurality of toner particles that each contain a binder resin. The toner particles each contain as the binder resin, a crystalline polyester resin and a non-crystalline polyester resin. An FT-IR spectrum of the toner obtained through FT-IR analysis based on an attenuated total reflection (ATR) method has an absorbency peak of at least 0.0100 and no greater than 0.0250 in a wave number range of 701 $cm^{-1}$±1 $cm^{-1}$. The method used for measuring the FT-IR spectrum is the same method as that used in Examples described later or an alternative method thereof.

In the present embodiment, a resin having a crystallinity index of at least 0.90 and no greater than 1.50 is referred to as a crystalline resin. The crystallinity index of a resin corresponds to a ratio (=Tm/Mp) of a softening point (Tm) relative to a melting point (Mp) of the resin. Mp and Tm of a resin can be measured based on the same method as in Examples described later or an alternative method thereof. In order that the toner has feature (1), the toner particles preferably each contain a crystalline polyester resin having a crystallinity index of at least 0.98 and no greater than 1.20. The crystallinity index of a polyester resin can be adjusted by changing the type or amount of a material for synthesis of the polyester resin (for example, alcohol and/or carboxylic acid).

The toner having feature (1) is advantageous for improvement on high-temperature preservability, fixability, and charge stability (see Tables 1-4 indicated later). In feature (1), the absorbency peak appearing in a wave number range of 701 $cm^{-1}$±1 $cm^{-1}$ is considered as a peak derived from an aromatic ring. The present inventor has found that in an FT-IR spectrum of a toner excellent in all of high-temperature preservability, fixability, and charge stability, an absorbency peak appearing in a wave number range of 701 $cm^{-1}$±1 $cm^{-1}$ falls within the range defined in feature (1). FIG. 1 is a spectral chart indicating examples of FT-IR spectra. Lines L11-L14 in FIG. 1 indicate respective FT-IR spectra (L11: toner C, L12: toner B, L13: tone A, L14: toner M) measured for respective toners according to examples and comparative examples, which will be described later. In order that the toner has feature (1), the toner preferably has a Tg (glass transition point) of at least 55° C. and no greater than 65° C. The measuring method of the Tg (glass transition point) is the same method as that used in Examples described later or an alternate method thereof.

In order to improve high-temperature preservability, fixability, and charge stability of the toner, the toner particles preferably each contain a crystalline polyester resin having a repeating unit derived from a styrene-based monomer and particularly preferably contain a crystalline polyester resin having a repeating unit expressed by the following chemical formula (1).

(1)

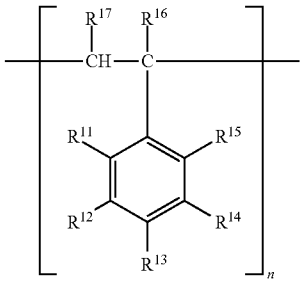

In the chemical formula (1), $R^{11}$-$R^{15}$ each represent, independently of one another, a hydrogen atom, a halogen atom, a hydroxyl group, an optionally substituted alkyl group, an optionally substituted alkoxy group, an optionally substituted alkoxy alkyl group, or an optionally substituted aryl group. Further, $R^{16}$ and $R^{17}$ each represent, independently of each other, a hydrogen atom, a halogen atom, or an optionally substituted alkyl group. Preferably, $R^{11}$-$R^{15}$ each represent, independently of one another, a hydrogen atom, a halogen atom, an alkyl group having a carbon number of 1-4, an alkoxy group having a carbon number of 1-4, or an alkoxy alkyl group having a carbon number (specifically, a total carbon number of alkoxy and alkyl) of 2-6. Preferably, $R^{16}$ and $R^{17}$ each represent, independently of each other, a hydrogen atom or a methyl group. A combination of $R^{17}$ represented by a hydrogen atom and $R^{16}$ represented by a hydrogen atom or a methyl group is particularly preferable. In the repeating unit derived from styrene, $R^{11}$-$R^{17}$ each represent a hydrogen atom.

The toner particles preferably each contain as the crystalline polyester resin, a polymer of monomers including at least one alcohol monomer, at least one carboxylic acid monomer, at least one styrene-based monomer, and at least one acrylic acid-based monomer in order to obtain a toner excellent in high-temperature preservability, fixability, and charge stability. The monomers of the polymer particularly preferably include at least two diols each having a carbon number of 3-8 (for example, butanediol and hexanediol), at least one divalent carboxylic acid (for example, fumaric acid), at least one styrene-based monomer (for example, styrene), and at least one (meth)acrylic acid alkyl ester (for example, methacrylic acid butyl). The toner particles preferably each contain in addition as the non-crystalline polyester resin, a polymer of monomers including at least two bisphenols and at least two dibasic carboxylic acids (more preferably, a polymer of monomers including a bisphenol A ethylene oxide adduct, a bisphenol A propylene oxide adduct, dodecenylsuccinic acid, and terephthalic acid) in order to obtain a toner excellent in high-temperature preservability, fixability, and charge stability.

In order to obtain a toner excellent in high-temperature preservability, fixability, and charge stability, it is preferable that: the crystalline polyester resin and the non-crystalline polyester resin contained in the toner particles preferably each have a mass average molecular weight of at least 2,000 and no greater than 5,000; the number average molecular weight of the crystalline polyester resin is at least 15,000 and no greater than 40,000; and the number average molecular weight of the non-crystalline polyester resin is at least 90,000 and no greater than 120,000.

In order to obtain a toner excellent in high-temperature preservability, fixability, and charge stability, it is preferable that: the crystalline polyester resin and the non-crystalline polyester resin contained in the toner particles preferably each have an acid value of at least 1 mg KOH/g and no greater than 10 mg KOH/g; the hydroxyl value of the crystalline polyester resin is at least 15 mg KOH/g and no greater than 20 mg KOH/g; and the hydroxyl value of the non-crystalline polyester resin is at least 35 mg KOH/g and no greater than 45 mg KOH/g.

A description will be made next about a configuration of a non-capsule toner particle. Specifically, a toner mother particle (a binder resin and an internal additive) and an external additive will be described in order.

<Preferable Thermoplastic Resins>

Examples of preferable thermoplastic resins that can be contained in the toner particles (particularly, toner mother particles) include styrene-based resins, acrylic acid-based resins (specific examples include an acrylic acid ester polymer and a methacrylic acid ester polymer), olefin-based resins (specific examples include polyethylene resin, and polypropylene resin), vinyl resins (specific examples include vinyl chloride resin, polyvinyl alcohol, vinyl ether resin, and N-vinyl resin), polyester resins, polyamide resins, and urethane resins. A copolymer of any of the above listed resins, that is, a copolymer in which any repeating unit is introduced into the resin (specific examples include a styrene-acrylic acid-based resin and a styrene-butadiene-based resin can be used favorably.

The thermoplastic resin is obtainable through addition polymerization, copolymerization, or condensation polymerization of at least one thermoplastic monomer. The thermoplastic monomer is a monomer that is to become a thermoplastic resin through homopolymerization (specific examples include an acrylic acid-based monomer and a styrene-based monomer) or a monomer that is to become a thermoplastic resin through condensation polymerization (specific examples include an alcohol and a carboxylic acid that each are to become a polyester resin through condensation polymerization).

The styrene-acrylic acid-based resin is a copolymer of at least one styrene-based monomer and at least one acrylic acid-based monomer. Preferable examples of styrene-based monomers and acrylic acid-based monomers that can be used for synthesis of a styrene-acrylic acid-based resin are listed below. A carboxyl group can be introduced into a styrene-acrylic acid-based resin by using an acrylic acid-based monomer. A hydroxyl group can be intruded into a styrene-acrylic acid-based resin by using a monomer having a hydroxyl group (specific examples include p-hydroxystyrene, m-hydroxystyrene, and (meth)acrylic acid hydroxyalkyl ester). The acid value of a resultant styrene-acrylic acid-based resin can be adjusted by appropriately adjusting the amount of the acrylic acid-based monomer. The hydroxyl value of a resultant styrene-acrylic acid-based resin can be adjusted by appropriately adjusting the amount of the monomer having the hydroxyl group.

Preferable examples of the styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of the acrylic acid-based monomers include (meth)acrylic acid, (meth)acrylonitrile, (meth) acrylic acid alkyl ester, and (meth)acrylic acid hydroxyalkyl ester. Preferable examples of (meth)acrylic acid alkyl ester include (meth)methyl acrylate, (meth)ethyl acrylate, (meth) n-propyl acrylate, (meth)iso-propyl acrylate, (meth)n-butyl acrylate, (meth)iso-butyl acrylate, and (meth)2-ethylhexyl acrylate. Preferable examples of (meth)acrylic acid hydroxyalkyl esters include (meth)acrylic acid 2-hydroxyethyl, (meth)acrylic acid 3-hydroxypropyl, (meth)acrylic acid 2-hydroxypropyl, and (meth) acrylic acid 4-hydroxybutyl.

The polyester resin can be obtained through condensation polymerization of at least one alcohol and at least one carboxylic acid. Examples of alcohols that can be preferably used for synthesis of the polyester resin include dihydric alcohols (specific examples include diols and bisphenols) and tri-hydric alcohols. Specific examples of these alcohols are listed below. Examples of carboxylic acids that can be preferably used for synthesis of the polyester resin include dibasic or tri- or higher-basic carboxylic acids listed below. The acid value and the hydroxyl value of the polyester resin can be adjusted by appropriately changing the respective amounts of the alcohol and the carboxylic acid during synthesis of the polyester resin. The acid value and the hydroxyl value of the polyester resin tend to decrease as the molecular weight of the polyester resin increases.

Preferable examples of the diols used include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide (EO) adduct, and bisphenol A propylene oxide (PO) adduct.

Preferable examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include maleic acid, fumaric acid, citraconic acid, itaconic acid, glutaconic acid, phthalic acid, isophthalic acid, terephthalic acid, cyclohexane dicarboxylic acid, adipic acid, sebacic acid, azelaic acid, malonic acid, succinic acid, alkyl succinic acid (specific examples include n-butylsuccinic acid, isobutylsuccinic acid, n-octylsuccinic acid, n-dodecylsuccinic acid, and isododecylsuccinic acid), and alkenyl succinic acid (specific examples include n-butenylsuccinic acid, isobutenylsuccinic acid, n-octenylsuccinic acid, n-dodecenylsuccinic acid, and isododecenylsuccinic acid).

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Alternatively, an ester-forming derivative (specific example include an acid halide, an acid anhydride, and a lower alkyl ester) of any of the above di-, tri-, or higher-basic carboxylic acids may be used. The term "lower alkyl" herein refers to an alkyl group having from one to six carbon atoms.

[Toner Mother Particles]

The toner mother particles each contain a binder resin. The toner mother particles may each further contain an internal additive (for example, a colorant, a releasing agent, a charge control agent, and a magnetic powder).

(Binder Resin)

The binder resin generally constitutes a large proportion (for example, at least 85% by mass) of components contained in the toner mother particles. Properties of the binder resin are therefore expected to have great influence on an overall property of the toner mother particles. For example, in a configuration in which the binder resin has an ester group, a hydroxyl group, an ether group, an acid group, or a methyl group, the toner mother particles are highly likely to be anionic. In a configuration in which the binder resin has an amino group or an amide group, the toner mother particles are highly likely to be cationic.

The toner according to the present embodiment has feature (1) as described above. In the toner of the present embodiment, the toner mother particles each contain as the binder resin, a crystalline polyester resin and a non-crystalline polyester resin. The toner mother particles may each contain a resin (specific examples are the "preferable thermoplastic resins" described above) other than a polyester resin as a binder resin.

In order that the toner has feature (1), the toner mother particles each preferably contain a crystalline polyester resin having a repeating unit derived from a styrene-based monomer. In order that the toner has feature (1), the toner mother particles preferably each contain as the crystalline polyester resin, a polymer of monomers including at least one alcohol monomer, at least one carboxylic acid monomer, at least one styrene-based monomer, and at least one acrylic acid-based monomer. It is particularly preferable that the toner mother particles each contain a polymer of 1,4-butanediol, 1,6-hexanediol, fumaric acid, styrene, and butyl methacrylate.

In order to improve high-temperature preservability of the toner in a configuration in which the toner mother particles contain as the crystalline polyester resin, a polymer of monomers including at least one alcohol monomer, at least one carboxylic acid monomer, at least one styrene-based monomer, and at least one acrylic acid-based monomer, the amount of the styrene-based monomer (where plural styrene-based monomers are included, the total amount thereof) is preferably at least 1 molar part and no greater than 15 molar parts relative to 100 molar parts of the carboxylic acid monomer in the polymer, and more preferably at least 2.5 molar parts and no greater than 12 molar parts.

In order to improve compatibility between the crystalline polyester resin and the non-crystalline polyester resin in a configuration in which the toner mother particles contains as the crystalline polyester resin, a polymer of monomers including at least two diols each having a carbon number of 3-8, at least one dibasic carboxylic acid, at least one styrene-based monomer, and at least one (meth)acrylic acid alkyl ester, the toner mother particles preferably each include as the non-crystalline polyester resin, a polymer of monomers including at least two bisphenols and at least two dibasic carboxylic acids. Further preferably, the monomers of the polymer include bisphenol A-EO adduct, bisphenol A-PO adduct, dodecenylsuccinic acid, and terephthalic acid.

In order to improve charge stability of the toner, the crystalline polyester resin contained in the toner mother particles preferably has an acid value of at least 2.5 mg KOH/g and no greater than 4.0 mg KOH/g, and more preferably at least 3.0 mg KOH/g and no greater than 3.5 mg KOH/g. In order to improve charge stability of the toner, the crystalline polyester resin contained in the toner mother particles preferably has a hydroxyl value of at least 5 mg KOH/g and no greater than 20 mg KOH/g.

In order to improve charge stability of the toner, the non-crystalline polyester resin contained in the toner mother particles preferably has an acid value of at least 5 mg KOH/g and no greater than 20 mg KOH/g, and more preferably at least 6 mg KOH/g and no greater than 15 mg KOH/g. In order to improve charge stability of the toner, the non-crystalline polyester resin contained in the toner mother particles has a hydroxyl value of at least 10 mg KOH/g and no greater than 45 mg KOH/g.

In order to improve strength of the toner particles and fixability of the toner, the crystalline polyester resin contained in the toner mother particles preferably has a number average molecular weight (Mn) of at least 3,300 and no greater than 3,800. In order to improve strength of the toner particles and fixability of the toner, the crystalline polyester resin contained in the toner mother particles preferably has a molecular weight distribution (a ratio Mw/Mn of mass average molecular weight (Mw) relative to number average molecular weight (Mn)) of at least 5 and no greater than 20.

In order to improve strength of the toner particles and fixability of the toner, the non-crystalline polyester resin contained in the toner mother particles preferably has a number average molecular weight (Mn) of at least 2,000 and no greater than 4,000. In order to improve strength of the toner particles and fixability of the toner, the non-crystalline polyester resin contained in the toner mother particles has a molecular weight distribution (a ratio Mw/Mn of mass average molecular weight (Mw) relative to number average molecular weight (Mn)) is preferably at least 5 and no greater than 40.

(Colorant)

The toner mother particles may each contain a colorant. The colorant can be a known pigment or dye that matches the color of the toner. The amount of the colorant is preferably at least 1 part by mass and no greater than 20 parts by mass relative to 100 parts by mass of the binder resin, and more preferably at least 3 parts by mass and no greater than 10 parts by mass in order to form a high-quality image with the toner.

The toner mother particles may contain a black colorant. Carbon black can be used as the black colorant. The black colorant may be a colorant that is adjusted to a black color using a yellow colorant, a magenta colorant, and a cyan colorant.

The toner mother particles may contain a non-black colorant such as a yellow colorant, a magenta colorant, or a cyan colorant.

Examples of yellow colorants that can be used singly or in combination include condensed azo compounds, isoindolinone compounds, anthraquinone compounds, azo metal complexes, methine compounds, and arylamide compounds. Specific examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

Examples of magenta colorants that can be used singly or in combination include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of magenta colorants that can be preferably used include C.I. Pigment Red (for example, 2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of cyan colorants that can be used singly or in combination include copper phthalocyanine compounds, anthraquinone compounds, and basic dye lake compounds. Specific examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles may each contain a releasing agent. The releasing agent is used for example in order to improve fixability of the toner or resistance of the toner to being offset. The amount of the releasing agent is preferably at least 1 part by mass and no greater than 30 parts by mass relative to 100 parts by mass of the binder resin, and more preferably at least 3 parts by mass and no greater than 15 parts by mass in order to improve the fixability or the offset resistance of the toner.

Examples of releasing agents that can be preferably used include aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon wax such as polyethylene oxide wax and block copolymer thereof; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes containing fatty acid ester as a main component such as montanic acid ester wax and castor wax; and waxes obtained by deoxidizing part or whole of fatty acid ester such as deoxidized carnauba wax. A single releasing agent may be used. Alternatively, plural releasing agents may be used in combination.

A compatibilizer may be added to the toner mother particles in order to improve compatibility between the binder resin and the releasing agent.

(Charge Control Agent)

The toner mother particles may each contain a charge control agent. The charge control agent is used for example in order to improve charge stability or a charge rise characteristic of the toner. The charge rise characteristic of the toner is an indicator as to whether the toner can be charged to a specific charge level in a short period of time.

The anionic strength of the toner mother particles can be increased through the toner mother particles containing a negatively chargeable charge control agent. The cationic strength of the toner mother particles can be increased through the toner mother particles containing a positively chargeable charge control agent. However, if sufficient chargeability is secured in the toner, there is no need to use a charge control age.

(Magnetic Powder)

The toner mother particles may each contain a magnetic powder. Examples of materials of the magnetic powder that can be preferably used include ferromagnetic metals (specific examples include iron, cobalt, and nickel) or an alloy thereof, ferromagnetic metal oxides (specific examples include ferrite, magnetite, and chromium dioxide), and materials subjected to ferromagnetization (more specifically, thermal treatment or the like). A single magnetic powder may be used. Alternatively, plural magnetic powders may be used in combination.

[External Additive]

An external additive may be caused to adhere to the surfaces of the respective toner mother particles. For example, when the external additive is stirred together with the toner mother particles, the external additive adheres (physically bond) to the surfaces of the respective toner mother particles by physical force. The external additive may be used for example in order to improve fluidity or handling property of the toner. The amount of the external additive (in a situation in which plural external additives are used, the total amount thereof) is preferably at least 0.5 parts by mass and no greater than 10 parts by mass relative to 100 parts by mass of the toner mother particles in order to improve fluidity or handling property of the toner. In order to improve fluidity or handling property of the toner, the external additive preferably has a particle size of at least 0.01 μm and no greater than 1.0 μm.

A preferable example of the external additive is inorganic particles. Silica particles or particles of a metal oxide (specific examples of metal oxides include alumina, titanium oxide, magnesium oxide, zinc oxide, strontium titanatem, and barium titanate) are further preferable. However, resin particles may be used as the external additive. A single external additive may be used. Alternatively, plural external additives may be used in combination.

[Toner Producing Method]

A toner producing method according to the present embodiment preferably has the following feature (2).

(2) The toner producing method includes a preparatory process, a melt-kneading process, and a pulverization process. The preparatory process to prepare a crystalline polyester resin involves causing condensation at least one alcohol and at least one carboxylic acid and causing a reaction between the resultant condensate, at least one styrene-based compound, and at least one acrylic acid-based compound. The melt-kneading process to obtain a melt-kneaded substance involves melt-kneading a toner material containing at least the crystalline polyester resin and a non-crystalline polyester resin. The pulverization process involves pulverizing the melt-kneaded substance.

Feature (2) is advantageous in easy and preferable production of the toner having feature (1). The toner producing method according to the present embodiment will be described further in detail by way of example.

(Preparatory Process)

An example of the preparatory process will be described below. In the preparatory process, materials to be used for producing a toner are prepared. For example, a crystalline polyester resin is prepared in a manner that condensation between at least one alcohol and at least one carboxylic acid is caused to obtain a condensate and the condensate is caused to react with at least one styrene-based compound and at least one acrylic acid-based compound. Further, a non-crystalline polyester resin is prepared through condensation between at least one alcohol and at least one carboxylic acid. The resultant crystalline polyester resin and non-crystalline polyester resin are used as a binder resin.

(Melt-Kneading Process)

An example of the melt-kneading process will be described below. In the melt-kneading process, the toner materials including the binder resin (for example, the binder resin, a colorant, a releasing agent, and a charge control agent) are mixed together to obtain a mixture. The resultant mixture is then melt-kneaded to obtain a melt-kneaded substance. A mixing device (for example, an FM mixer) can favorably mix the toner materials. A two-axis extruder, a three-roll kneader, and a tow-roll kneader can favorably melt-kneads the mixture. A masterbatch containing a binder resin and a colorant may be used as the toner materials.

(Pulverization Process)

An example of the pulverization process will be described below. First, the melt-kneaded substance is cooled using a cooling and solidifying device such as a drum flaker. Subsequently, the resultant solidified substance is coarsely pulverized using a first pulverizing apparatus. The resultant coarsely pulverized substance is further pulverized using a second pulverizing apparatus to obtain a pulverized substance having a desired particle size.

(Washing Process)

After the pulverizing process, the toner mother particles may be washed with water, for example. The toner mother particles are washed preferably in a manner for example that a toner mother particle-containing dispersion is solid-liquid separated to collect a wet cake of the toner mother particles and the resultant wet cake of the toner mother particles is washed with water. Another preferred example of the method for washing the toner mother particles involves precipitating the toner mother particles contained in a toner mother particle-containing dispersion, substituting the supernatant with water, and re-dispersing the toner mother particles in water after substitution.

(Drying Process)

After the washing process, the toner mother particles may be dried. For example, the toner mother particles can be dried using a dryer (specific examples include a spray dryer, a fluidized bed dryer, a vacuum freeze dryer, and a reduced pressure dryer). A spray dryer is preferably used for inhibiting aggregation of the toner mother particles during the drying process. In a situation in which the spray dryer is used, the drying process can be performed simultaneously with an external addition process, which will be described later, through for example spraying toward the toner mother particles a dispersion in which an external additive (a specific example is silica particles) is dispersed.

(External Addition Process)

An external additive may be caused to adhere to the surfaces of the respective toner mother particles. When the toner mother particles and the external additive are mixed together using a mixer under conditions where the external additive are not buried in surface portions of the respective toner mother particles, the external additive can adhere to the surfaces of the respective toner mother particles.

Through the above processes, the toner including a large number of toner particles can be produced. Noted that non-essential processes may alternatively be omitted. For example, in a situation in which a commercially available product can be used directly as a material among the materials, the use of the commercially available product can eliminate the need of preparation of the material. In a configuration in which the external additive do not adhere to the surfaces of the toner mother particles (i.e., a situation in which the external addition process is omitted), the toner mother particles and the toner particles are equivalent. Preferably, a large number of the toner particles are formed at the same time in order to produce the toner efficiently. The toner particles produced at the same time have substantially the same configuration.

EXAMPLES

Following describes examples of the present disclosure. Table 1 indicates toners A-N (electrostatic latent image developing toners) according to examples and comparative examples. Tables 2 and 3 indicate resins A1-A5 and resins B1-B5 used in production of the respective toners A-N. The term "ratio" in Table 2 means each amount (molar part) of the materials relative to 100 molar parts of fumaric acid.

TABLE 1

| Toner | FT-IR Peak (701 $cm^{-1}$) | Tg [° C.] | Binder resin [part by mass] | Releasing agent [part by mass] | Charge control agent [part by mass] | Colorant [part by mass] |
|---|---|---|---|---|---|---|
| Toner A | 0.0102 | 56.1 | A1/B1 = 20/80 | 4 | 1 | 6 |
| Toner B | 0.0181 | 55.6 | A2/B1 = 20/80 | | | |
| Toner C | 0.0249 | 55.1 | A3/B1 = 20/80 | | | |
| Toner D | 0.0265 | 42.0 | A4/B1 = 20/80 | | | |
| Toner E | 0.0091 | 57.2 | A5/B1 = 20/80 | | | |
| Toner F | 0.0179 | 57.4 | A2/B2 = 20/80 | 4 | 1 | 6 |
| Toner G | 0.0185 | 63.4 | A2/B3 = 20/80 | | | |
| Toner H | 0.0182 | 66.1 | A2/B4 = 20/80 | | | |
| Toner I | 0.0186 | 53.7 | A2/B5 = 20/80 | | | |
| Toner J | 0.0150 | 55.5 | A1/B1 = 30/70 | 4 | 1 | 6 |
| Toner K | 0.0125 | 56.8 | A3/B1 = 10/90 | | | |
| Toner L | 0.0087 | 57.0 | A3/B1 = 5/95 | | | |
| Toner M | 0.0089 | 54.9 | A5/B1 = 30/70 | | | |
| Toner N | 0.0087 | 57.4 | B1 = 100 | 4 | 1 | 6 |

TABLE 2

| Crystalline polyester resin | | A1 | A2 | A3 | A4 | A5 |
|---|---|---|---|---|---|---|
| a1: Amount | 1,4-butanediol | 990 g (84.0) | 960 g (81.5) | 901 g (76.5) | 901 g (66.5) | 1060 g (90) |
| (ratio) | 1,6-hexanediol | 242 g (11.0) | 187 g (8.5) | 77 g (3.5) | 77 g (3.5) | 220 g (10) |
| a2: Amount | Fumaric acid | 1480 g (100.0) | 1480 g (100.0) | 1480 g (100.0) | 1480 g (100.0) | 1480 g (100) |

TABLE 2-continued

| Crystalline polyester resin | | A1 | A2 | A3 | A4 | A5 |
|---|---|---|---|---|---|---|
| (ratio) | | | | | | |
| s-a: Amount (ratio) | Styrene | 69 g (2.8) | 138 g (5.6) | 276 g (11.2) | 428 g (17.4) | — |
| | Butyl methacrylate | 54 g (2.2) | 108 g (4.4) | 216 g (8.8) | 309 g (12.6) | — |
| Softening point [° C.] | | 88.8 | 88.7 | 89.7 | 88.8 | 88.4 |
| Melting point [° C.] | | 82.0 | 78.5 | 77.4 | 70.5 | 85.0 |
| Crystallinity index | | 1.08 | 1.13 | 1.16 | 1.26 | 1.04 |
| Acid value [mg KOH/g] | | 3.1 | 3.0 | 3.5 | 3.9 | 1.0 |
| Hydroxyl value [mg KOH/g] | | 19.0 | 7.0 | 11.1 | 14.0 | 30.8 |
| Mass average molecular weight (Mw) | | 27500 | 53600 | 61800 | 76800 | 7370 |
| Number average molecular weight (Mn) | | 3620 | 3590 | 3540 | 3490 | 3680 |
| Molecular weight distribution (Mw/Mn) | | 7.6 | 14.9 | 17.5 | 22.0 | 2.0 |

TABLE 3

| Non-crystalline polyester resin | | B1 | B2 | B3 | B4 | B5 |
|---|---|---|---|---|---|---|
| b1: Amount [g] | BPA-PO | 1700 | 1900 | 1500 | 1500 | 1700 |
| | BPA-EO | 650 | 700 | 300 | 300 | 600 |
| b2: Amount [g] | Dodecenyl succinic anhydride | 500 | 300 | — | — | 700 |
| | Terephthalic acid | 400 | 500 | 800 | 900 | 200 |
| Softening point [° C.] | | 124.8 | 142.2 | 111.6 | 111.6 | 126.3 |
| Glass transition point [° C.] | | 57.2 | 58.0 | 64.2 | 68.2 | 54.0 |
| Acid value [mg KOH/g] | | 6.0 | 14.0 | 15.0 | 13.0 | 15.0 |
| Hydroxyl value [mg KOH/g] | | 41.0 | 34.5 | 14.0 | 18.0 | 40.0 |
| Mass average molecular weight (Mw) | | 109475 | 75190 | 18733 | 14120 | 51670 |
| Number average molecular weight (Mn) | | 3737 | 2153 | 2641 | 2862 | 2059 |
| Molecular weight distribution (Mw/Mn) | | 29.3 | 34.9 | 7.1 | 4.9 | 25.1 |

Following describes a production method, an evaluation method, and evaluation results for the respective toners A-N in order. In evaluations in which errors may occur, an evaluation value was calculated by calculating the arithmetic mean of an appropriate number of measured values in order to ensure that any errors were sufficiently small. Tg (a glass transition point), Mp (a melting point), and Tm (a softening point) are each measured as follows unless otherwise stated.

<Tg and Mp Measuring Method>

Figure 2:
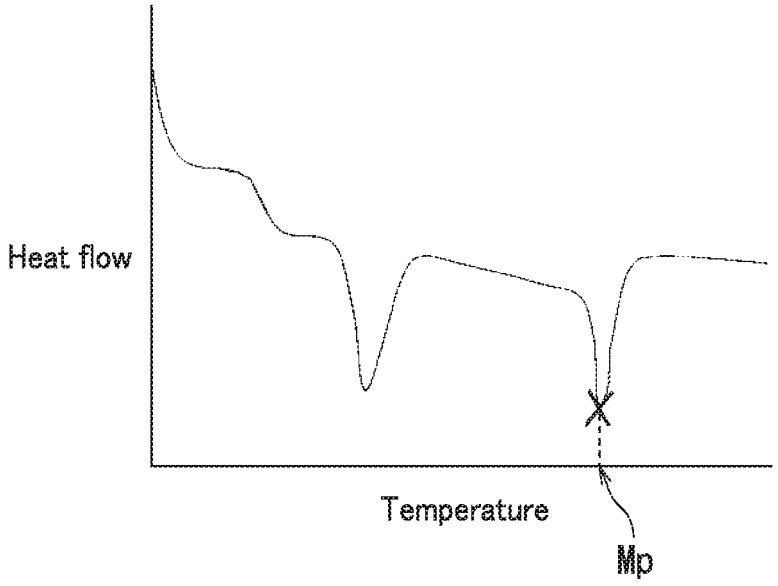
FIG. 2 is a graph representation explaining a method for measuring a Mp (melting point).
Figure 3:
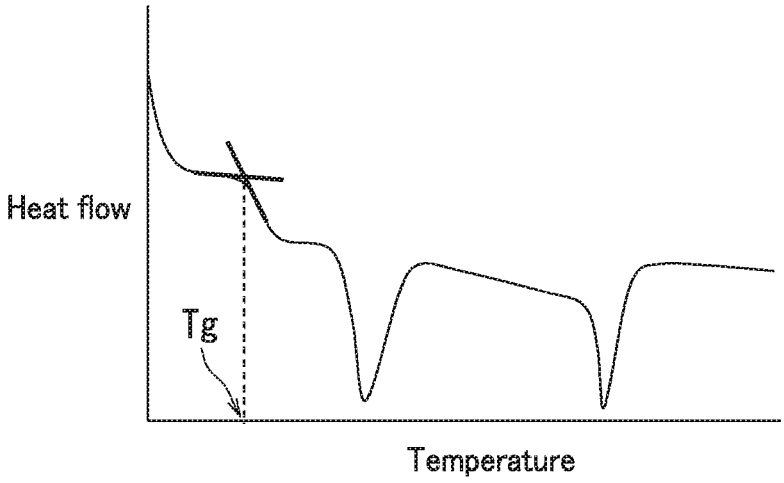
FIG. 3 is a graph representation explaining a method for measuring a Tg (glass transition point).

A differential scanning calorimeter (DSC-6220 manufactured by Seiko Instruments Inc.) was used as a measuring device. Tg and Mp of a sample were obtained from a heat absorption curve that was plotted by measuring a sample using the measuring device. Specifically, 15 mg of a sample (for example, polyester resin) was put on an aluminum dish (aluminum container) and the aluminum dish was set on a measuring section of the measuring device. An empty aluminum dish was also used for reference. For plotting a heat absorption curve, the temperature of the measuring section was raised at a rate of 10° C./min from 10° C. that is a temperature at a measurement start to 150° C. (RUN 1). Then, the temperature of the measuring section is lowered at a rate of 10° C./min from 150° C. to 10° C. Subsequently, the temperature of the measuring section is raised again at a rate of 10° C./min from 10° C. to 150° C. (RUN 2). Through RUN 2, a heat absorption curve (vertical axis: heat flow (DSC signal), horizontal axis: temperature) of the sample was plotted. Mp and Tg of the sample were read from the plotted heat absorption curve. For example, Mp (a melting point) of the sample is a maximum peak temperature in the heat absorption curve that is due to heat of fusion, as indicated in FIG. 2. Tg (a glass transition point) of the sample is a temperature at a point of variation (intersection between an extrapolation line of a base line and an extrapolation line of a fall line) of the specific heat in the heat absorption curve, as illustrated in FIG. 3.

<Tm Measuring Method>

Figure 4:
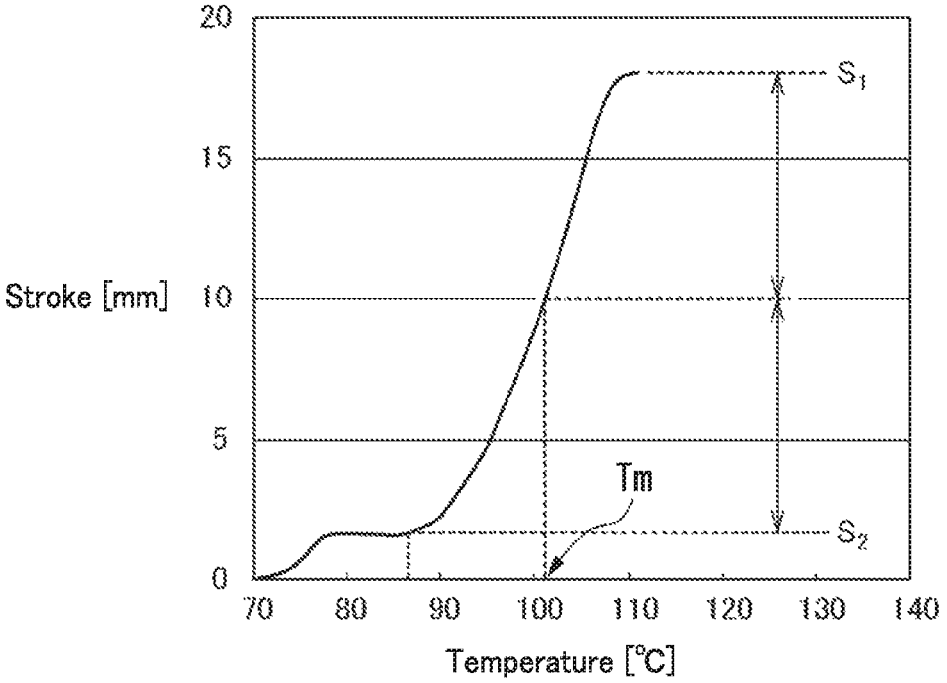
FIG. 4 is a graph representation explaining a method for measuring a Tm (softening point).

An S-shaped curve (horizontal axis: temperature, vertical axis: stroke) was plotted by setting a sample (for example, polyester resin) in an elevated type flow tester (CFT-500D produced by Shimadzu Corporation) and causing melt-flow of 1 $cm^3$ of a sample under conditions of a die pore diameter of 1 mm, a plunger load of 20 $kg/cm^2$, and a heating rate of 6° C./minute. Subsequently, Tm of the sample was read from the plotted S-shaped curve. For example, Tm (a softening point) of the measurement sample is a temperature on the plotted S-shaped curve illustrated in FIG. 4 corresponding to a stroke value of $(S_1+S_2)/2$, where $S_1$ represents a maximum stroke value and $S_2$ represents a base line stroke value at low temperatures.

<FT-IR Spectrum Measuring Method>

The measuring device used was a Fourier transform infrared (FT-IR) spectrometer (Frontier produced by PerkinElmer, Inc. The measurement mode employed was an attenuated total reflection (ATR) mode. Diamond (refractive index of 2.4) was used as an ATR crystal.

The ATR crystal was set on the measuring device, and 1 mg of a sample (for example, a toner) was placed on the ATR crystal. Subsequently, the sample was pressurized under a load of at least 60 N and no greater than 80 N using a pressure arm of the measuring device. The FT-IR spectrum of the sample was measured at a grazing angle of an infrared ray of 45 degrees. An absorbency peak (base line: 690 $cm^{-1}$ to 710 $cm^{-1}$) appearing in a wave number range of 701 $cm^{-1}$±1 $cm^{-1}$ was determined from the measured FT-IR spectrum. FIG. 1 indicates FT-IR spectra (L11: toner C, L12: toner B, L13: toner A, and L14: toner M) measured for respective toners A-C and M.

[Method for Producing Toner A]

(Synthesis of Crystalline Polyester Resin A1)

Into a 5-L four-necked flask equipped with a thermometer (thermocouple), a dewatering tube, a nitrogen inlet tube, and a stirrer, 990 g (84 molar parts) of 1,4-butanediol (a component in a1: alcohol component), 242 g (11 molar parts) of 1,6-hexanediol (a component in a1: alcohol component), 1,480 g (100 molar parts) of fumaric acid (a component in a2: acid component), and 2.5 g of 1,4-benzenediol were introduced. The flask contents were then caused to react at a temperature of 170° C. for 5 hours. The flask contents were subsequently caused to react at a temperature of 210° C. for 1.5 hours. Thereafter, the flask contents were caused to react in a reduced pressure atmosphere (a pressure of 8 kPa) at a temperature of 210° C. for 1 hour. After the atmosphere is returned to a normal pressure atmosphere, 69 g (2.8 molar parts) of styrene (a component in s-a: styrene-acrylic acid-based component) and 54 g (2.2 molar part) of n-butyl methacrylate (a component in s-a: styrene-acrylic acid-based component) were added into the flask. The flask contents were then caused to react at a temperature of 210° C. for 1.5 hours. Subsequently, the flask contents were caused to react in a pressure-reduced atmosphere (pressure of 8 kPa) at a temperature of 210° C. for 1 hour. As a result, a crystalline polyester resin A1 was obtained. The crystalline polyester resin A1 had properties indicated in Table 2 (Tm: 88.8° C., Mp: 82° C., acid value: 3.1 mg KOH/g, hydroxyl value: 19 mg KOH/g, Mw: 27,500, Mn: 3,620).

(Synthesis of Non-Crystalline Polyester Resin B1)

Into a 5-L four-necked flask equipped with a thermometer (thermocouple), a dewatering tube, a nitrogen inlet tube, and a stirrer, 1,700 g of bisphenol A-PO (propylene oxide) adduct (a component in b1: alcohol component), 650 g of bisphenol A-EO (ethylene oxide) adduct (a component in b1: alcohol component), 500 g of n-dodecenyl succinic anhydride (a component in b2: acid component), 400 g of terephthalic acid (a component in b2: acid component), and 4 g of dibutyl tin oxide were added. The flask contents were then caused to react at a temperature of 220° C. for 9 hours. The flask contents were subsequently caused to react in a reduced pressure atmosphere (a pressure of 8 kPa), thereby obtaining a non-crystalline polyester resin B1 having a softening point (Tm) indicated in Table 3. The non-crystalline polyester resin B1 had properties indicated in Table 3 (Tm: 124.8° C., Tg: 57.2° C., acid value: 6 mg KOH/g, hydroxyl value: 41 mg KOH/g, Mw: 109,475, Mn: 3,737).

(Preparation of Toner Mother Particles)

An FM mixer (FM-20B produced by Nippon Coke & Engineering Co., Ltd.) was used to mix 20 parts by mass of the crystalline polyester resin A1, 80 parts by mass of the non-crystalline polyester resin B1, 6 parts by mass of carbon black (MA-100 produced by Mitsubishi Chemical Corporation), 4 parts by mass of ester wax (Nissan Elector (registered Japanese trademark) WEP-9 produced by NOF Corporation), and 1 parts by mass of quaternary ammonium salt (BONTRON (registered Japanese trademark) P-51 produced by ORIENT CHEMICAL INDUSTRIES, Co., Ltd.).

A resultant mixture was then melt-kneaded using a two-screw extruder (PCM-30 produced by Ikegai Corp.) under conditions of a material feeding speed of 6 kg/hour, a shaft rotational speed of 160 rpm, and a cylinder temperature of 120° C. The resulting melt-knead product was subsequently cooled. Thereafter, the cooled melt-kneaded produce was coarsely pulverized using a pulverizer (Rotoplex (registered Japanese trademark) produced by Hosokawa Micron Corporation). Subsequently, the resultant coarsely pulverized substance was finely pulverized using a pulverizer (Turbo Mill RS produced by FREUND-TURBO CORPORATION). The finely pulverized substance was then classified using a classifier (Elbow Jet EJ-LABO produced by Nittetsu Mining Co., Ltd.). The resultant toner mother particles had a volume median diameter of 7 μm.

(External Addition Process)

An FM mixer (FM-10B produced by Nippon Coke & Engineering Co., Ltd.) was used to mix 100 parts by mass of the toner mother particles, 1.2 parts by mass of hydrophobic silica particulates (RA-200H produced by Nippon Aerosil Co., Ltd.), and 0.8 parts by mass of conductive titanium oxide particulates (EC-100 produced by Titan Kogyo, Ltd.) under conditions of a rotational speed of 3000 rpm and a jacket temperature of 20° C. for 2 minutes. Through the above, the external additive adhered to the surfaces of the respective toner mother particles. Next, sifting was performed using a 300 mesh sieve (opening 48 μm). As a result, a toner A including a large number of toner particles was yielded. The toner A had properties indicated in Table 1 (an absorbency peak appearing in a wave number range of 701 $cm^{-1}$±1 $cm^{-1}$: 0.0102, Tg: 56.1° C.).

[Methods for Producing Toners B-E]

Toners B-E were prepared according to the same method as the toner A in all aspects other than that respective crystalline polyester resins A2-A5 were used instead of the crystalline polyester resin A1. The crystalline polyester resins A2-A5 were synthesized according to the same method as the crystalline polyester resin A1 in all aspects other than that the amounts of respective materials were changed to those indicated in Table 2. In synthesis of the crystalline polyester resin A5, neither styrene nor butyl methacrylate was used. The respective crystalline polyester resins A2-A5 had properties indicated in Table 2. The toners B-E had properties indicated in Table 1.

[Method for Producing Toners F-I]

The toners F-I were prepared according to the same method as the toner B in all aspects other than that respective non-crystalline polyester resins B2-B5 were used instead of the non-crystalline polyester resin B1. The non-crystalline polyester resins B2-B5 were synthesized according to the same method as the non-crystalline polyester resin B1 in all aspects other than that the amounts of respective materials were changed to those indicated in Table 3. Dodecenyl succinic anhydride was not used in synthesis of the respective non-crystalline polyester resins B3 and B4. The respective non-crystalline polyester resins B2-B5 had properties indicated in Table 3. The toners F-I had properties indicated in Table 1.

[Method for Producing Toner J]

The toner J was prepared according to the same method as the toner A in all aspects other than that the amount of the crystalline polyester resin A1 was changed from 20 parts by mass to 30 parts by mass and the amount of the non-crystalline polyester resin B1 was changed from 80 parts by mass to 70 parts by mass. The toner J had properties indicated in Table 1.

[Method for Producing Toner K]

The toner K was prepared according to the same method as the toner C in all aspects other than that the amount of the crystalline polyester resin A3 was changed from 20 parts by mass to 10 parts by mass and the amount of the non-crystalline polyester resin B1 was changed from 80 parts by mass to 90 parts by mass. The toner K had properties indicated in Table 1.

[Method for Producing Toner L]

The toner L was prepared according to the same method as the toner C in all aspects other than that the amount of the crystalline polyester resin A3 was changed from 20 parts by mass to 5 parts by mass and the amount of the non-crystalline polyester resin B1 was changed from 80 parts by mass to 95 parts by mass. The toner L had properties indicated in Table 1.

[Method for Producing Toner M]

The toner M was prepared according to the same method as the toner E in all aspects other than that the amount of the crystalline polyester resin A5 was changed from 20 parts by mass to 30 parts by mass and the amount of the non-crystalline polyester resin B1 was changed from 80 parts by mass to 70 parts by mass. The toner M had properties indicated in Table 1.

[Method for Producing Toner N]

The toner N was prepared according to the same method as the toner A in all aspects other than that the crystalline polyester resin A1 was not used. The toner N had properties indicated in Table 1.

[Evaluation Method]

The following describes an evaluation method of each sample (toners A-N).

(Lowest Fixing Temperature and Highest Fixing Temperature)

A two-component developer was prepared by mixing 100 parts by mass of a developer carrier (carrier for FS-05250DN) with 5 parts by mass of a sample (toner) using a ball mill for 30 minutes.

An image was formed using the two-component developer prepared as above. Then, a lowest fixing temperature and a highest fixing temperature of the sample were evaluated. As an evaluation apparatus, a color printer (FS-05250DN produced KYOCERA Document Solutions Inc.) equipped with a Roller-Roller type heat pressure fixing unit was modified so as to be capable of changing the fixing temperature. The two-component developer prepared as above was introduced into a developing unit of the evaluation apparatus, and the sample (toner for replenishment) was charged into a toner container of the evaluation apparatus.

The above evaluation apparatus was used to form a solid image having a size of 25 mm by 25 mm on a part of a sheet of paper ($C^2$ 90 produced by Fuji Xerox Co., Ltd., A4-size plain paper having a basis weight of 90 g/$m^2$) having a length of 10 mm from the trailing edge thereof under conditions of a linear velocity of 200 mm/sec. and a toner applied amount of 1.0 mg/$cm^2$. Subsequently, the sheet on which the image was formed was caused to pass through a fixing unit of the evaluation apparatus.

The fixing temperature was set in a range of at least 100° C. and no greater than 200° C. in evaluation of the lowest fixing temperature. Specifically, a lowest temperature (lowest fixing temperature) at which a solid image (toner image) was able to be fixed to the sheet was measured while the fixing temperature of the fixing unit was increased 5° C. at a time from 100° C. Whether or not toner fixing was accomplished was checked by a fold-rubbing test as described below. Specifically, the fold-rubbing test was performed by folding the paper in half such that a surface on which the image was formed was folded inwards, and by rubbing a 1 kg weight covered with cloth back and forth on the fold five times. Next, the paper was opened up and a fold portion (i.e., a portion to which the solid image was fixed) was observed. The length of toner peeling of the fold portion (peeling length) was measured. The minimum fixing temperature was determined to be the lowest temperature among temperatures for which the peeling length was no greater than 1 mm. The toner was evaluated as excellent when the lowest fixing temperature was below 155° C., good when the lowest fixing temperature was 155° C., and poor when the lowest fixing temperature is beyond 155° C.

The fixing temperature was set in a range between 150° C. and 250° C. in evaluation of the highest fixing temperature. Specifically, a highest temperature (highest fixing temperature) at which toner offset does not occur was measured while the fixing temperature of the fixing unit was increased 5° C. at a time from 150° C. An evaluation sheet subjected to the fixing was visually checked as to whether or not offset occurred (whether or not toner was attached to a fixing roller). The toner was evaluated as excellent when the highest fixing temperature was beyond 180° C., good when the highest fixing temperature was 180° C., and poor when the highest fixing temperature is below 180° C.

(High-Temperature Preservability)

A 20-mL polyethylene container containing 2 g of a sample (toner) was left for 3 hours in a constant temperature bath set to 55° C. Thereafter, the container was taken out from the constant temperature bath and cooled to prepare a toner for evaluation use.

Next, the evaluation toner was placed on a 200 mesh (opening 75 μm) sieve of known mass. The mass of the sieve containing the evaluation toner was measured in order to obtain the mass of the toner prior to sifting. Next, the sieve was set in a powder tester (product of Hosokawa Micron Corporation) and was caused to vibrate in accordance with a manual of the powder tester at a rheostat level of 5 for 30 seconds in order to sift the evaluation toner. After sifting, the mass of the sieve including the toner was measured to obtain the mass of the toner remaining on the sieve. The mass of the toner pre-sifting and the mass of toner post-sifting (i.e., the mass of toner that remained on the sieve) were used to calculate a degree of aggregation (unit: % by mass) based on the following equation.

$$\text{Degree of aggregation} = 100 \times \text{toner mass post-sifting} / \text{toner mass pre-sifting}$$

The toner was evaluated as excellent when the degree of aggregation was no greater than 10% by mass, good when the degree of aggregation was greater than 10% by mass and no greater than 20% by mass, and poor when the degree of aggregation is greater than 20% by mass.

(Charge Decay Characteristic)

A charge decay constant (charge decay rate) of a sample (toner) before external addition, that is, toner mother particles of the sample (toner) was evaluated. An evaluation apparatus used was an electrostatic diffusivity measuring device (NS-D100 produced by Nano Seeds Corporation). The evaluation apparatus was capable of charging a sample while monitoring the charge decay constant of the charged sample using a surface electrometer. A method based on Japan Industrial Standard (JIS) C 61340-2-1-2006 was employed as an evaluation method. The method for evaluating the charge decay constant was described below in detail.

The toner mother particles of the sample (toner) were placed into a measurement cell. The measurement cell was a metal cell with a recess having an inner diameter of 10 mm and a depth of 1 mm. The toner mother particles were thrusted into the recess of the cell using a glass slide to be filled in the recess of the cell. Toner mother particles brimming over the cell were removed by reciprocating the glass slide on the surface of the cell. The amount of toner mother particles filled in the cell was 50 mg.

Subsequently, the measurement cell in which the toner mother particles were filled was left for 12 hours in an environment at a temperature of 32.5° C. and a humidity of 80% RH. Thereafter, the measurement cell was grounded and placed in the evaluation apparatus and the surface electrometer of the evaluation apparatus was adjusted to zero. Subsequently, the toner mother particles were charged by corona discharge under conditions of a voltage of 10 kV and a charge time period of 0.5 seconds. After elapse of 0.7 seconds from termination of the corona discharge, the surface potential of the toner mother particles was continuously recorded under conditions of a sampling frequency of 10 Hz and a maximum measurement time period of 300 seconds. A charge decay constant $\alpha$ in a decay time period of 2 seconds was calculated based on data of the recorded surface potential and an equation $V=V_0\exp(-\alpha\sqrt{t})$. In the equation, V represents a surface potential [V]; $V_0$ represents an initial surface potential [V]; and t represents a decay time period [second].

The toner mother particles were evaluated as excellent when the charge decay constant was less than 0.020, good when the charge decay constant was at least 0.020 and no greater than 0.025, and poor when the charge decay constant was greater than 0.025.

[Evaluation Results]

Table 4 indicates evaluation results of the respective samples (toners A-N). Evaluation results in Table 4 include results of each evaluation of lowest fixing temperature, highest fixing temperature, high-temperature preservability (degree of agglomeration), and charge decay characteristic (charge decay constant).

The respective toners A-C and F-K (toners of Examples 1-9) had feature (1) described above. Specifically, toilers A-C and F-K each contain as a binder resin, a crystalline polyester resin and a non-crystalline polyester resin (see Table 1). Each FT-IR spectrum of the toners A-C and F-K obtained through FT-IR analysis based on the ATR method had an absorbency peak of at least 0.0100 and no greater than 0.0250 in a wave number range of 701 $cm^{-1}\pm1$ $cm^{-1}$ (see Table 1). The toners A-C and F-K each were excellent in high-temperature preservability, fixability, and charge stability.

The methods for producing the respective toners A-C and F-K (methods for producing the respective toners of Examples 1-9) each had feature (2) described above. The methods of producing the respective toners A-C and F-K each included the preparatory process, the melt-kneading process, and the pulverization process. In the preparatory process, a crystalline polyester resin was prepared through condensation of at least one alcohol and at least one carboxylic acid followed by a reaction between the resultant condensate, at least one styrene-based compound, and at least one acrylic acid-based compound. In the melt-kneading process, a melt-kneaded substance was obtained by melt-kneading toner materials including the crystalline polyester resin and a non-crystalline polyester resin. In the pulverization process, the melt-kneaded substance was pulverized.

The toner D (toner of Comparative Example 1) was inferior to the toners of Examples 1-9 in high-temperature preservability. The reason therefor is considered as follows. Too much styrene and butyl methacrylate inhibited satisfactory crystallization of the crystalline polyester resin.

The toners E and M (toners of Comparative Examples 2 and 4) were inferior to the toners of Examples 1-9 in high-temperature fixability and charge stability. Styrene and butyl methacrylate were not used in the methods for producing the respective toners E and M. For the reason as above, charge retentivity of the toners E and M was considered to be low.

The toners L and N (toners of Comparative Examples 3 and 5) were inferior to the toners of Examples 1-9 in

TABLE 4

| | Toner | Lowest fixing temperature (Fold-rubbing test) [° C.] | Highest fixing temperature (non-offset) [° C.] | High-temperature preservability [% by mass] | Charge decay constant |
|---|---|---|---|---|---|
| Example 1 | Toner A | 135 | 185 | 5 | 0.0091 |
| Example 2 | Toner B | 140 | 185 | 7 | 0.0122 |
| Example 3 | Toner C | 145 | 190 | 9 | 0.0198 |
| Example 4 | Toner F | 145 | 195 | 8 | 0.0125 |
| Example 5 | Toner G | 140 | 185 | 7 | 0.0124 |
| Example 6 | Toner H | 155 | 180 | 5 | 0.0144 |
| Example 7 | Toner I | 150 | 180 | 11 | 0.0154 |
| Example 8 | Toner J | 130 | 185 | 7 | 0.0099 |
| Example 9 | Toner K | 150 | 190 | 10 | 0.0195 |
| Comparative Example 1 | Toner D | 150 | 180 | 28 (poor) | 0.0056 |
| Comparative Example 2 | Toner E | 140 | 175 (poor) | 8 | 0.0565 (poor) |
| Comparative Example 3 | Toner L | 165 (poor) | 195 | 14 | 0.0178 |
| Comparative Example 4 | Toner M | 125 | 165 (poor) | 8 | 0.0875 (poor) |
| Comparative Example 5 | Toner N | 175 (poor) | 210 | 6 | 0.0068 |

low-temperature fixability. It is considered that the reason therefor is too small amount of the crystalline polyester resin (non-use of a crystalline polyester resin in the toner N).

What is claimed is:

1. An electrostatic latent image developing toner comprising a plurality of toner particles each containing a binder resin, wherein the toner particles each contain as the binder resin, a crystalline polyester resin having a repeating unit derived from a styrene-based monomer and a non-crystalline polyester resin, the toner particles each containing no styrene-acrylic acid-based resin, and an FT-IR spectrum of the electrostatic latent image developing toner obtained through FT-IR analysis based on an ATR method has an absorbency peak of at least 0.0100 and no greater than 0.0250 in a wave number range of 701 $cm^{-1}$±1 $cm^{-1}$.

2. The electrostatic latent image developing toner according to claim 1, wherein the absorbency peak is derived from an aromatic ring.

3. The electrostatic latent image developing toner according to claim 1, wherein the toner particles each contain as the crystalline polyester resin, a polymer of monomers including at least one alcohol monomer, at least one carboxylic acid monomer, at least one styrene-based monomer, and at least one acrylic acid-based monomer.

4. The electrostatic latent image developing toner according to claim 3, wherein an amount of the styrene-based monomer in the polymer is at least 1 molar part and no greater than 15 molar parts relative to 100 molar parts of the carboxylic acid monomer.

5. The electrostatic latent image developing toner according to claim 1, wherein the toner particles each contains as the crystalline polyester resin, a polymer of monomers including at least two diols each having a carbon number between 3 and 8, at least one dibasic carboxylic acid, at least one styrene-based monomer, and at least one (meth)acrylic acid alkyl ester.

6. The electrostatic latent image developing toner according to claim 5, wherein the toner particles each contains as the crystalline polyester resin, a polymer of 1,4-butanediol, 1,6-hexanediol, fumaric acid, styrene, and butyl methacrylate.

7. The electrostatic latent image developing toner according to claim 5, wherein the toner particles each contains as the non-crystalline polyester resin, a polymer of monomers including at least two bisphenols and at least two dibasic carboxylic acids.

8. The electrostatic latent image developing toner according to claim 7, wherein the crystalline polyester resin and the non-crystalline polyester resin each have a mass average molecular weight of at least 2,000 and no greater than 5,000, the crystalline polyester resin has a number average molecular weight of at least 15,000 and no greater than 40,000, and the non-crystalline polyester resin has a number average molecular weight of at least 90,000 and no greater than 120,000.

9. The electrostatic latent image developing toner according to claim 7, wherein the crystalline polyester resin and the non-crystalline polyester resin each have an acid value of at least 1 mg KOH/g and no greater than 10 mg KOH/g, the crystalline polyester resin has a hydroxyl value of at least 15 mg KOH/g and no greater than 20 mg KOH/g, and the non-crystalline polyester resin has a hydroxyl value of at least 35 mg KOH/g and no greater than 45 mg KOH/g.

10. The electrostatic latent image developing toner according to claim 5, wherein the toner particles each contain as the non-crystalline polyester resin, a polymer of monomers including a bisphenol A ethylene oxide adduct, a bisphenol A propylene oxide adduct, dodecenyl succinic acid, and terephthalic acid.

11. The electrostatic latent image developing toner according to claim 1 that has a glass transition point of at least 55° C. and no greater than 65° C.

12. The electrostatic latent image developing toner according to claim 1, wherein the repeating unit derived from the styrene-based monomer is a repeating unit represented by formula (1) shown below:

(1)

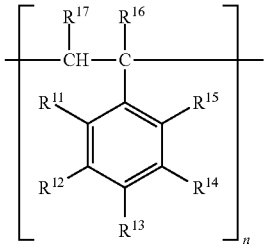

in formula (1), $R^{11}$ to $R^{15}$ each represent, independently of one another, a hydrogen atom, a halogen atom, an alkyl group having a carbon number of 1-4, an alkoxy group having a carbon number of 1-4, or an alkoxy alkyl group having a carbon number of 2-6, the carbon number of the alkoxy alkyl group being a total carbon number of alkoxy and alkyl, $R^{16}$ and $R^{17}$ each represent, independently of one another, a hydrogen atom or methyl group, and n represents a number of repetitions of a repeating unit.

* * * * *